United States Patent [19]

Kocher et al.

[11] 4,113,203

[45] Sep. 12, 1978

[54] METHOD AND APPARATUS FOR THRUST VECTOR CONTROL OF SPIN STABILIZED FLYING BODIES BY MEANS OF A SINGLE JET RUDDER

[75] Inventors: Heinz Kocher, Ottobrunn; Werner Kitzig; Piet Jozef Witteveen, both of Munich, all of Germany

[73] Assignee: Bölkow Gesellschaft mit beschränkter Haftung, Ottobrunn, Germany

[21] Appl. No.: 566,178

[22] Filed: Jul. 12, 1966

[30] Foreign Application Priority Data

Jul. 20, 1965 [DE] Fed. Rep. of Germany ..... B 82920

[51] Int. Cl.[2] ..... F42B 15/00

[52] U.S. Cl. ..... 244/3.11

[58] Field of Search ..... 244/3.11, 3.12, 3.14, 244/3.21, 3.22

[56] References Cited

U.S. PATENT DOCUMENTS

| | | | |
|---|---|---|---|
| 3,013,494 | 12/1961 | Chanut | 244/3.12 X |
| 3,149,568 | 9/1964 | Gerber | 244/3.12 X |
| 3,205,820 | 9/1965 | McCorkle, Jr. et al. | 244/3.21 |
| 3,224,710 | 12/1965 | Hermann et al. | 244/3.14 |
| 3,273,825 | 9/1966 | Kerner | 244/3.22 |
| 3,332,641 | 7/1967 | Bezerie | 244/3.12 |

*Primary Examiner*—Verlin R. Pendegrass

*Attorney, Agent, or Firm*—Toren, McGeady and Stanger

[57] ABSTRACT

A flying body, rotating about its rolling axis, supplies reference signals, in accordance with its angular position, to a control device which produces Cartesian horizontal and vertical control signals. The reference signals effect production of a sawtooth voltage in which each pulse corresponds to a 360° rotation of the flying body. Each voltage pulse produces at least three function potentials spaced from each other by 90°, and these function potentials are individually compared with the Cartesian control signals to produce respective pulse width modulating output potentials. These latter are combined to produce a control signal potential which is transmitted to the flying body and which is phase rigid with respect to the rolling position thereof and contains control information for a single control force producing device, on the flying body, with the control information being separate for the vertical and horizontal signal directions and in a timed sequence.

10 Claims, 6 Drawing Figures

INVENTORS
Heinz Kocher
Werner Kitzig
Piet Jozef Witteveen
by Mueller and Toren
ATTORNEYS INVENTORS
Heinz Kocher
Werner Kitzig
Piet Jozef Witteveen
by Merchant and Torrey
ATTORNEYS INVENTORS
Heinz Kocher
Werner Kitzig
Piet Jozef Witteven
by Mulgan and Torrence
ATTORNEYS INVENTORS
Heinz Kocher
Werner Kitzig
Piet Jozef Witteveen
by Mulglow and Forrow
ATTORNEYS

METHOD AND APPARATUS FOR THRUST VECTOR CONTROL OF SPIN STABILIZED FLYING BODIES BY MEANS OF A SINGLE JET RUDDER

BACKGROUND OF THE INVENTION

This invention relates to the guidance of flying bodies and, more particularly, to a novel method of and apparatus for the thrust vector control of such flying bodies by means of a single jet rudder which, to produce a guiding force for the flying body, is dipped into and deflects the single jet driving the flying body.

The actuation of such a jet rudder is responsive to guide signals transmitted to the flying body. These guide signals are formed as horizontal and vertical guide signals $K_y$ and $K_z$ of a cartesian coordinate system which is referred to the flying body and to an associated guide device. Prior to their transmission to the flying body, for example in the form of signal potentials, these horizontal and vertical guide signals are converted into polar guide signals $\theta$ and $\alpha$ by coordinate conversion and by the vector summation illustrated graphically in FIG. 1.

With respect to the control of a flying body by means of a single jet rudder, as in the present case, the entry and exit angles $\phi_1$ and $\phi_2$ (FIG. 2) for the jet rudder, for a rotation through 360° of the flying body, are calculated from the polar guide signals. More specifically, in each case the calculation is effected from the guide vector $\theta$ and the angle $\alpha$ as follows:

$$\phi_1 = \alpha - (a\theta/2)$$

$$\phi_2 = \alpha + (a\theta/2)$$

In the above formulae, $a$ is a constant factor.

In this manner, the constant relationship of the reference planes of the guide arrangement and of the rotating flying body is maintained, and a single jet rudder, for the angular ranges corresponding to the cartesian guiding signals calculated on the flying body rotating about its longitudinal axis, is dipped into the jet stream.

The constructional advantages and the increased reliability which are characteristic of thrust vector control of a rolling flying body by means of a single jet rudder have to be balanced against the great expenditure necessary for the coordinate transducer necessary for the conversion of the cartesian guide signals into polar guide signals. Alternatively, if a servo system is used, then the use of mechanical parts which are subject to wear and the lower limit of such a servo system, have to be considered. As is known to those skilled in the art, the guiding device, in contrast to the flying body proper, is not lost and does not have to be replaced after each use.

An object of the present invention is to provide a new method for controlling the thrust vector and which is free of the drawbacks of prior art methods.

Another object of the invention is to provide such a method for the control of the thrust vector in which simultaneously obtained vertical and horizontal guide signals are transmitted to the flying body in the form of timed control pulse sequences in each of which each pulse is phase rigid with respect to a respective angular position of rotation of the flying body.

A further object of the invention is to provide a new method for the control of the thrust vector, such as just mentioned, in which, by comparing the vertical and horizontal signal potentials with function-potentials, each of which is phase rigid with respect to a respective angular position of rotation of the flying body, control signals are produced in the manner of a pulse width modulation.

Yet another object of the invention is to provide such a method for the control of the thrust vector wherein the pulse widths of the guide pulses, in each instance, are proportional to the respective signal potentials.

A further object of the invention is to provide a method for the control of the thrust vector and based on the consideration that the simultaneously obtained horizontal and vertical guide signals, which normally are simultaneously required for guiding the course of a flying body having a single jet rudder, are obtained in the form of timed control pulse sequences in each of which each pulse is effective in a respective angular position of rotation of the rotating flying body.

Due to the rotational inertia of the flying body, the transverse forces, which are caused by the guide signals given successively in different angular ranges, are so integrated that these cause the same change in the course of the flying body as would be caused by the guide signals $K_y$ and $K_z$.

In this manner, the stable signal sector positions, as illustrated in FIG. 3, are obtained. In these stable signal sector positions, only the sector widths, corresponding to the magnitude of the respectively given guide signals, may continuously change. With respect to a constant sector position, the following relation obtains:

Guide signal "left" $\beta = 90°$
Guide signal "high" $\gamma = 180°$
Guide signal "right" $\delta = 270°$ The associated exit and entry angles of the jet rudder, with a variable sector width, then are:

$$\phi_2 - \phi_1, \phi_4 - \phi_3, \text{ or } \phi_6 - \phi_5$$

In the foregoing:

$$\phi_2 - \phi_1 = ak_y \text{ for } K_y < 0$$

$$\phi_4 - \phi_3 = aK_z \text{ for } K_z \geqq 0$$

$$\phi_6 - \phi_5 = aK_y \text{ for } K_y > 0$$

This means that coordinate transducers or servosystems are no longer required. Furthermore, due to the gravitational pull acting on the flying body, it is unnecessary to use a further sector position for "low" signals so that the sector position $\epsilon = 360°$ is vacant and thus may be used for other signals or for return information from the flying body to the guide device and to the guide station. Additionally, the association of the obtained cartesian guide signals with the respective angular positions of rotation of the flying body may now be effected by logic circuits, so that a simple electronic construction and design of the guiding arrangement is possible.

In accordance with a further object of the invention, two function potentials are produced which are phase rigid relative to the angular position of rotation of the flying body. These function potentials are produced both in the horizontal and also in the vertical signal directions.

According to a preferred embodiment of the invention, however, only a single function potential is produced in the vertical signal direction, and is phase rigid to the angular position of rotation of the flying body.

Thereby, the guide pulses derived therefrom are directed in their action direction in opposition to the earth's gravity.

A further object of the invention is to provide a thrust vector control method, as mentioned, in which, in order to increase the response sensitivity and to compensate for dead periods of the jet rudder system, the signal potential in the horizontal signal direction, in the vertical signal direction, or in both signal directions, is superposed by a bias potential or "pre-potential" which preferably is variable.

Another object of the invention is to provide a control apparatus for performing the control method of the invention.

A further object of the invention is to provide such a control apparatus including at least three function generators, controlled by a synchronizing unit, for producing function potentials which are phase rigid relative to respective angular positions of rotation of the flying body.

Still another object of the invention is to provide such a control apparatus, comprising comparators connected to the outputs of the function generators and which are also connected with a guide device for producing the cartesian guide signals as well as with an addition stage connected to the outputs of the comparators. From this addition stage, there can be taken output pulse signals comprising the guide signals.

For an understanding of the principles of the invention, reference is made to the following description of a typical embodiment thereof as illustrated in the accompanying drawings.

Figure 1:
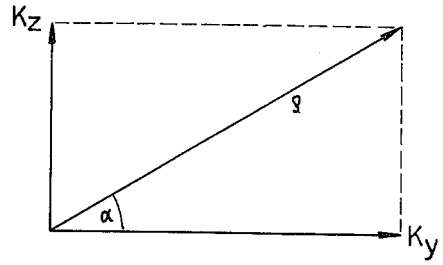
FIGS. 1, 2 and 3 are graphs illustrating the underlying principls of the invention.
Figure 2:
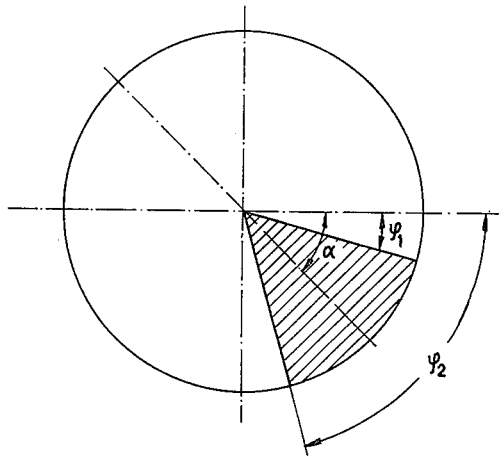

To facilitate an understanding of the invention, reference will be made first to FIG. 6 which illustrates the jet rudder 1 necessary for carrying out the thrust vector control in accordance with the invention. Rudder 1 is fixedly secured on a rotatable pin 2 and, with its edge-shaped end 3, can be moved transversely of the opening of a nozzle 4 of a jet engine (not shown), for example a solid fuel rocket. This movement can be effected by two opposing electromagnets 5 and 6. An armature plate 7 is arranged between electromagnets 5 and 6 and is fixedly secured to pin 2. Each of the electromagnets 5 and 6 is supplied, by a diagrammatically illustrated conductor pair 8, 9, with signal potentials embodying guide signals, the supply of the guide signals being described further on.

Pin 2, to which jet rudder 1 is fixed, is mounted on a member 10 which is connected through a spacer 11 with a spar element or frame member 13 carrying the electromagnets 5 and 6. Member 13 is situated at the rear end of the flying body (not shown).

Figure 4:
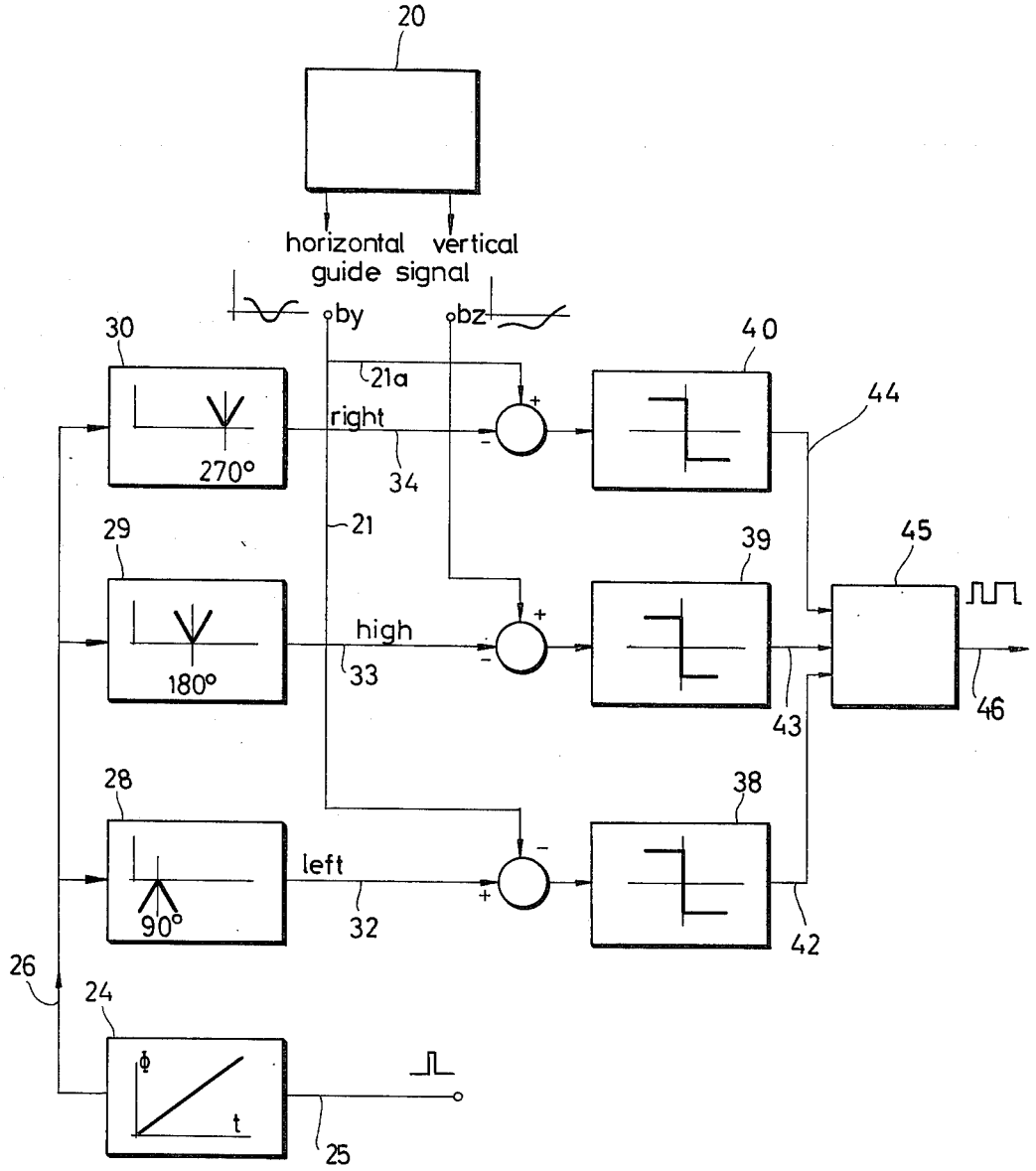
FIG. 4 is a block circuit diagram of control apparatus for performing the invention method.

The guide signals necessary for guiding of the flying body are produced in a known manner, not shown in this case, in a guide device 20 (FIG. 4), i.e., in the form of the previously mentioned cartesian guide signals $K_y$ and $K_z$. The guide signals are supplied through connections 21 and 22 into the switching device positioned at the place of a guiding device and which, in FIG. 4, has been shown as a block circuit. This switching device processes the guide signals in accordance with the method of the invention.

Figure 5:
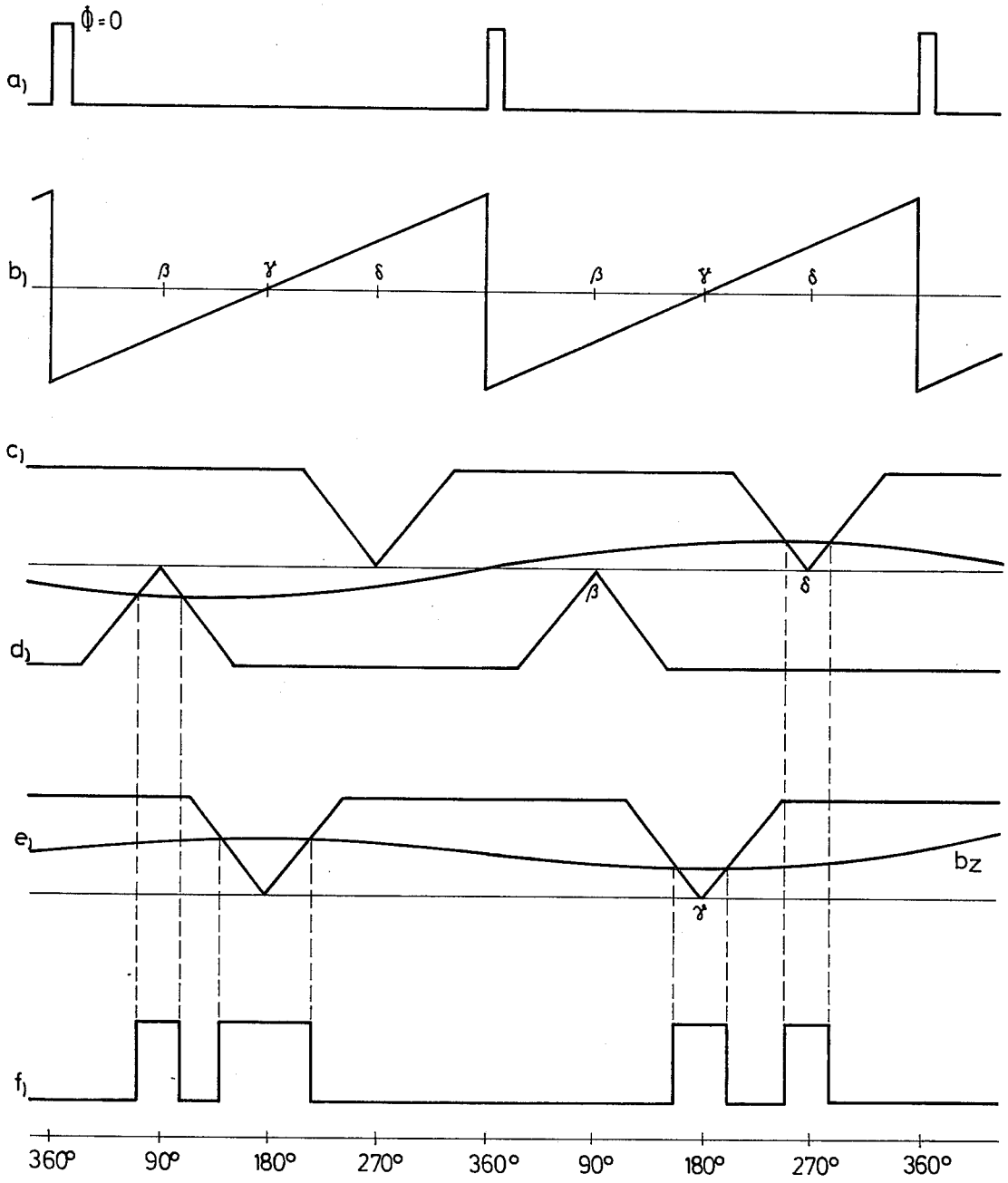
FIG. 5 is a pulse diagram related to FIG. 4.

The guiding arrangement consists essentially of the synchronizing unit 24, which, through a connection 25, is supplied with synchronizing or timing pulses such as illustrated in FIG. 5*a*, and which are emitted from the flying body during its flight. These synchronizing pulses determine the respective angular position of rotation of the flying body.

Figure 3:
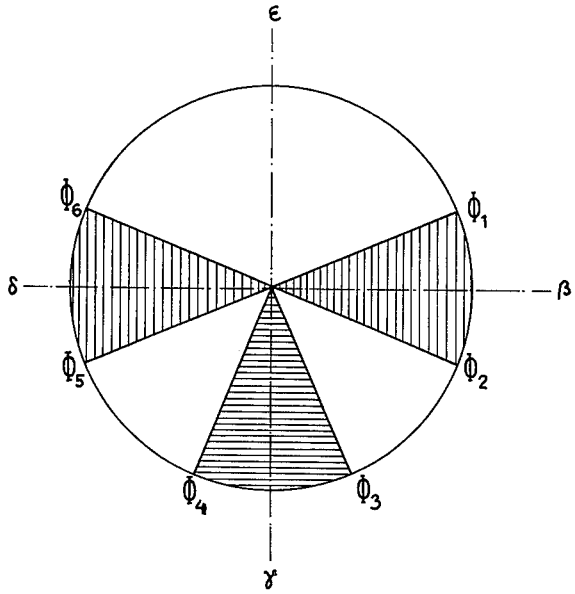

In dependence on the synchronizing pulses, a saw tooth potential is produced in the synchronizing unit, and this saw tooth potential is shown in FIG. 5*b*. The saw tooth potential switches or controls the function generators 28, 29 and 30 through a connection 26. Each of the function generators supplies a triangular shape function potential, as shown in FIGS. 5*c*, 5*d* and 5*e*. The potential peaks of the triangular shape function potentials, calculated on a rolling movement of the flying body through 360°, occur at 90°, with respect to function generator 28, at 180°, with respect to function generator 29, and at 270°, with respect to function generator 30. In this manner, the signal sector positions $\beta$, $\gamma$ and $\delta$ of the flying body, as shown in FIG. 3, are defined.

The function potentials are supplied, through respective connections 32, 33 and 34, to respective comparators 38, 39 and 40. Comparators 38, 39 and 40 are also supplied with the signal potentials of guide device 20 through respective lines 21, 21*a* and 22. These signal potentials are designated *by* and *bz* in FIG. 4, and reference is also made to FIGS. 5*c* and 5*e*.

Figure 6:
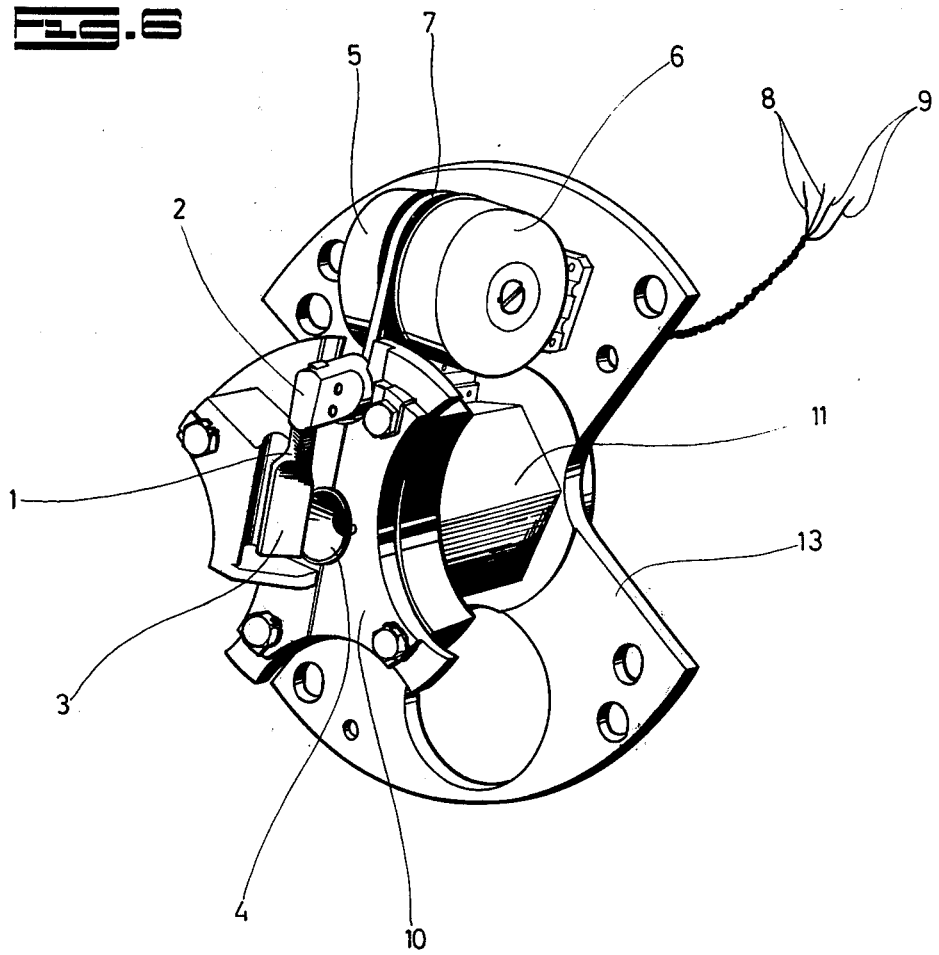
FIG. 6 is a perspective view of a jet rudder system.

By comparing the signal potentials *by* and *bz* with the potentials of the function generators 28, 29 and 30 in the comparators 38, 39 and 40, the control pulses for the jet rudder shown in FIG. 6 are produced in the manner of pulse width modulation, known per se. For reference, see FIGS. 5*c* through 5*e*. The pulse width is proportional to the values of the respective signal potentials *by* and *bz*.

The outputs 42, 43 and 44 of the respective comparators 38, 39 and 40 lead to an addition stage 45 in which the pulses which arrive through these output lines are combined into a pulse sequence, such as shown in FIG. 5*f*. This pulse sequence, in a known manner which has not been herein illustrated, is transmitted from output 46 to the flying body and supplied to the electromagnets 5 and 6 and thus to jet rudder 1. This jet rudder causes the flight path or directional change of the flying body as instructed by the guiding device 20.

In the embodiment of the invention shown in the drawings, function generator 28 and its comparator 38 are associated with the guide signal "left," while function generator 30 and its comparator 40 are associated with the guide signal "right." Function generator 29 and its comparator 39 are associated with the signal "high." It will be noted that there are always two function potentials which are phase rigid with respect to a respective angular position of rotation of the flying body, associated in each case with the horizontal signal direction as will be seen in FIGS. 5*c* and 5*d*. By contrast, only one phase rigid function potential is associated with the vertical signal direction, as best seen in FIG. 5*e*, while the action direction of the derived control pulses is in opposition to earth's gravity. In this manner, the signal sector indicated in FIG. 3 at $\epsilon$ is free for other purposes.

It is, of course, possible to supply two phase rigid function potentials, which are phase rigid with respect to respective angular positions of rotation of the flying body, in the vertical signal direction. In such a case, the switching arrangement of FIG. 4 would have to be amplified by an additional functional generator whose triangular shape function potential would be effective at 360°. An additional comparator, of course, would be required.

The jet rudder 1, which consists of mechanical elements and which is electromagnetically actuated, has dead periods or delay periods which reduce the signal efficiency with small lateral signal factors, for example small angular differences of $$\phi_2 - \phi_1, \phi_4 - \phi_3, \text{ or } \phi_6 - \phi_5$$

In order to minimize or, if possible, to render completely ineffective these dead periods or delay periods, it is possible to superimpose the signal potentials *by* and *bz*, respectively, with adjustable positive and negative bias potentials, for example through a potentiometer. A falsification of the "right"-"left" signal cannot result therefrom since the effect of the bias potential is eliminated during a rolling movement of the flying body through 360°.

While a specific embodiment of the invention has been shown and described in detail to illustrate the application of the principles of the invention, it will be understood that the invention may be embodied otherwise without departing from such principles.

What is claimed is:

1. In a method for the control, by a single control force producing device, of a flying body rotating about its rolling axis, and utilizing control signal producing means producing coordinated Cartesian horizontal and vertical control signals and supplied with reference signals produced by the flying body in accordance with its angular position about its rolling axis: the improvement comprising utilizing said reference signals to produce, in said control signal producing means, a sawtooth voltage in which each sawtooth voltage pulse corresponds to a 360° rotation of said flying body; utilizing each sawtooth voltage pulse to produce at least three function potentials spaced from each other by 90°; individually comparing each function potential with said Cartesian control signals to produce a respective pulse width modulating output potential; and combining said pulse width modulating potentials, corresponding to each 360° rotation of said flying body, to produce a control signal potential transmitted to said flying body, and which is phase rigid with respect to the angular position of said flying body about its rolling axis and contains, for the respective 360° rotation of said flying body, control information, for said control force producing device, which is separate for the vertical and horizontal directions and is in timed sequence.

2. A method, as claimed in claim 1, in which said flying body is a thrust vector controlled flying body and said single control force producing device is a jet rudder; said function potentials being triangular function potential pulses.

3. A method, as claimed in claim 1, including the steps of producing, in the horizontal signal direction, two function potentials spaced 180° apart and each of which is phase rigid with respect to a respective angular position of the flying body about its rolling axis; and producing, in the vertical signal direction, at least one function potential which is spaced 90° from each of said function potentials in the horizontal direction and which is phase rigid with respect to a respective angular position of the flying body about its rolling axis.

4. A method, as claimed in claim 1, including the step of producing, in the vertical signal direction, a single function potential which is phase rigid with respect to a respective angular position of the flying body about its rolling axis and the direction of action of the control pulses of which is in opposition to the earth's gravitational attraction.

5. A method, as claimed in claim 1, including the step of superposing a bias potential on said signal potentials to increase the response sensitivity and to compensate for response time delay of said control force producing device.

6. A method, as claimed in claim 5, including the step of adjusting said bias potential.

7. Apparatus for the control, by a single control force producing device, of a flying body rotating about its rolling axis, the flying body supplying reference signals in accordance with its angular position about its rolling axis, said apparatus comprising, in combination, control signal producing means producing coordinated Cartesian horizontal and vertical control signals; voltage generating means operable, responsive to receipt of said reference signals, to produce a sawtooth voltage with each sawtooth voltage pulse corresponding to a 360° rotation of said flying body; function potential generating means connected to said voltage generating means and operable, responsive to each sawtooth voltage pulse, to produce at least three function potentials spaced from each other by 90° and each corresponding to a respective angular position of said flying body about its rolling axis; comparison means connected to said Cartesian control signal producing means and to said function potential generating means and operable to compare each function potential individually with said Cartesian control signals to produce a respective pulse width modulating output potential; and combining means connected to the output of said comparison means and combining said pulse widths modulating potentials, corresponding to each 360° rotation of said flying body, to produce a control signal potential transmitted to said flying body; said control signal potentials being phase rigid with respect to the rolling position of said flying body and containing, for the respective 360° rotation of said flying body, control information, for said control force producing device, which is separate for the vertical and horizontal directions and is in a timed sequence.

8. Apparatus, as claimed in claim 7, in which said function potential generating means comprises at least three function potential generators; said voltage generating means comprising a synchronizing unit controlling said function potential generators to produce function potentials each of which is phase rigid with respect to a respective angular position of rotation of the flying body.

9. Apparatus, as claimed in claim 8, in which said comparison means comprises respective comparators each connected to the output of a respective function potential generator and to at least one output of said Cartesian control signal producing means.

10. Apparatus, as claimed in claim 9, in which said combining means comprises an addition stage commonly connected to the output of said comparators.

* * * * *